US012091797B2

(12) United States Patent
Vlandis et al.

(10) Patent No.: US 12,091,797 B2
(45) Date of Patent: Sep. 17, 2024

(54) EMBROIDERY COLOR TRANSITION

(71) Applicant: Tajima Software Solutions Inc., Mississauga (CA)

(72) Inventors: Claude Vlandis, Bay Harbor Islands, FL (US); Brian J. Goldberg, Thornhill (CA); Danielle R. Fernandez, North York (CA); Si Ming Yang, Oakville (CA); William M. Collins, Oakville (CA); Robert R. McTavish, Hamilton (CA); Anastasios Tsonis, Vancouver (CA)

(73) Assignee: TAJIMA SOFTWARE SOLUTIONS INC., Mississauga (CA)

( * ) Notice: Subject to any disclaimer, the term of this patent is extended or adjusted under 35 U.S.C. 154(b) by 831 days.

(21) Appl. No.: 17/074,222

(22) Filed: Oct. 19, 2020

(65) Prior Publication Data

US 2022/0120001 A1 Apr. 21, 2022

(51) Int. Cl.
*D05C 5/02* (2006.01)
*D05B 19/12* (2006.01)
(Continued)

(52) U.S. Cl.
CPC ..... *D05C 5/02* (2013.01); *D05B 19/12* (2013.01); *D05C 7/00* (2013.01); *D05C 17/00* (2013.01)

(58) Field of Classification Search
CPC ..... D05C 5/02; D05C 7/00; D05C 11/24; D05B 19/12; D05B 67/00
See application file for complete search history.

(56) References Cited

U.S. PATENT DOCUMENTS 5,343,401 A 8/1994 Goldberg
5,430,658 A 7/1995 Divinsky
5,506,784 A 4/1996 Tsonis
5,510,994 A 4/1996 Tsonis
(Continued)

FOREIGN PATENT DOCUMENTS

WO 2020055299 3/2020
WO WO-2020055297 A1 * 3/2020 ..... D03J 1/04

OTHER PUBLICATIONS

Notice of References Cited for U.S. Appl. No. 16/006,627, Aug. 27, 2019.

(Continued)

*Primary Examiner* — Nathan E Durham
(74) *Attorney, Agent, or Firm* — Allan Watts

(57) ABSTRACT

Computerized methods of creating embroidery including capturing embroidery instructions, receiving instructions at an embroidery engine, creating planned patterns of stitches, and outputting instructions for stitching, including instructions for printing colors onto a thread before stitching. Color may be printed in a gradient or gradually faded, for example, from a start color to an end color, or from a start color to an intermediate color and from the intermediate color to an end color. Color may be gradually faded from a start location to an end location or from a start location to an intermediate location and from the intermediate location to an end location. Varying shades of colors may be printed, patterns may be repeated, outlines, segments, and vectors may be used, and intermediate stitch color may be determined based on number of stitches or vector length. Some embodiments allow a user to change embroidery instructions while reapplying unchanged instructions.

20 Claims, 4 Drawing Sheets

(51) Int. Cl.
*D05C 7/00* (2006.01)
*D05C 17/00* (2006.01)

(56) References Cited

U.S. PATENT DOCUMENTS

| | | | | |
|---|---|---|---|---|
| 5,541,847 | A | 7/1996 | Tsonis | |
| 5,668,730 | A | 9/1997 | Tsonis | |
| 5,771,173 | A | 6/1998 | Tsonis | |
| 5,809,921 | A | 9/1998 | Mok | |
| 5,865,134 | A | 2/1999 | Okuyama | |
| 5,924,372 | A | 7/1999 | Okuda | |
| 5,924,374 | A | 7/1999 | Mori | |
| 5,893,200 | A | 11/1999 | Slotznick | |
| 5,988,083 | A | 11/1999 | Tomita | |
| 6,012,404 | A | 1/2000 | Ogawa | |
| 6,012,890 | A | 1/2000 | Garrido | |
| 6,189,989 | B1 * | 2/2001 | Hirabayashi | D06P 5/30 427/288 |
| 6,196,146 | B1 * | 3/2001 | Goldberg | D05B 19/10 705/26.1 |
| 6,216,618 | B1 | 4/2001 | Goldberg | |
| 6,968,255 | B1 | 11/2005 | Dimaridis | |
| 8,069,091 | B1 * | 11/2011 | Callen, Jr. | G06Q 30/0603 705/26.5 |
| 10,590,580 | B2 | 3/2020 | Tsonis | |
| 2005/0060058 | A1 | 3/2005 | Cameron | |
| 2012/0143717 | A1 | 6/2012 | Gardener | |

OTHER PUBLICATIONS

ISR for PCT/CA2021/051177, Pulse Microsystems Ltd.

Written Opinion for PCT/CA2021/051177, Pulse Microsystems Ltd.

"How to create an embroidery with Coloreel"; YouTube Video by Coloreel; "5,814 views Sep. 25, 2018"; URL: https://www.youtube.com/watch?v=Vxf2eQmx62I.

Coloreel comments on US patent application publication US2022120001A1 in comparison to above Coloreel YouTube Video (Said comments: Not known to have been published; Postdate 2022 publication of said patent application).

Publication Submission to JPO, English Machine Translation for JP 2023-547724, (JP National Phase of PCT/CA2021/051177), submitted by a third-party, Citing Coloreel YouTube Video.

Publication Submission to JPO, In Japanese, for JP 2023-547724, Citing Coloreel YouTube Video.

Coloreel Video Screen Shots submitted to JPO for JP 2023-547724.

Observations by 3rd party concerning patentability of EP 21881402.8-1017 / EP4229232 PCT/CA2021051177, Jan. 12, 2024, Anonymous, Citing Coloreel YouTube Video.

Coloreel; "How to Create an Embroidery with Coloreel"; screenshot pp. 1-7; YouTube Video by Coloreel; posted Sep. 25, 2018, https://www.youtube.com/watch?v=Vxf2eQmx62I.†

* cited by examiner
† cited by third party

EMBROIDERY COLOR TRANSITION

FIELD THE INVENTION

Various embodiments of this invention relate to computerized methods, systems, and software for creating (e.g., customized) embroidery. Particular embodiments concern methods, systems, and software for color transition in (e.g., customized) embroidery.

BACKGROUND OF THE INVENTION

Machine embroidery has been performed by sewing threads onto fabric in a pattern. The thread has been pulled by a sewing head of an embroidery machine from a cone of thread. The thread was typically a single color. Variegated thread has been used for certain purposes, including a cone of thread of more than one color in a sequence. Variegated thread, however, is typically not used in machine embroidery, among other things, because the placement of the colors in the embroidery design cannot practically be predicted. As a result of this and other circumstances, in the past, embroidery designs have included just one or only a few colors. Where multiple colors were used, each color was sewn in a block, and blocks of different colors were sewn in sequence so that the thread did not need to be changed on the machine frequently, which is time consuming. So, for example, the red portion of a design might be sewn first, followed by blue, etc.

Computerized methods, systems, and software have been contemplated for creating embroidery, including customized embroidery for a user. In addition, various methods, systems, and software have been described that used the Internet for communication. U.S. Pat. Nos. 5,343,401, 6,196,146, and 10,590,580, describe examples (all Goldberg). Prior art, however, has been limited, for example, in the way the color of a creative work from a user has been captured, defined, communicated, or stitched, as examples.

Room for improvement exists over the prior art in systems and methods for creating (e.g., customized) embroidery, for instance, including concerning color and color transitions. Further, potential for improvement exists in computerized systems and methods and in the way embroidery instructions are captured and used to create a planned pattern of stitches used for stitching the embroidery. Still further, room for improvement exists in the way a creative work from a user, desired stitching parameters, or both, are captured, defined, or communicated, for example, to an embroidery engine. Further still, room for improvement exists in the way colors are transitioned in embroidery. Potential for benefit exists in these and other areas that may be apparent to a person of skill in the art having studied this document.

SUMMARY OF PARTICULAR EMBODIMENTS OF THE INVENTION

Various embodiments are or include a (e.g., computerized) system, method, or program, for example, for creating (e.g., customized) embroidery, for example, for a user. In many embodiments, for instance, a method includes (e.g., using a computer or computing device), various acts. In various embodiments, for example, such acts may include (e.g., using a computing device), for example, capturing embroidery instructions, receiving the embroidery instructions at an embroidery engine, creating a planned pattern of stitches, outputting a first set of instructions for a thread printer, and outputting a second set of instructions for an embroidery machine. Some embodiments further specifically include allowing the user to change certain embroidery instructions while maintaining a particular color pattern.

In various specific embodiments, for example, a (e.g., computerized) method of creating customized embroidery for a user includes capturing embroidery instructions from the user. In a number of embodiments, for instance, the embroidery instructions include color instructions, for example, identifying multiple different colors. Further, in various embodiments, the colors include a start color and an end color. Further still, various embodiments include a start location and an end location (e.g., within the customized embroidery). Still further, various methods include receiving the embroidery instructions (e.g., including the color instructions) at an embroidery engine. Even further, various embodiments include creating a planned pattern of stitches, for example, from the embroidery instructions. Even further still, various embodiments include: outputting a first set of instructions for a thread printer, for example, to print the multiple different colors onto a common strand of thread before the stitching of the customized embroidery (e.g., for the user), outputting a second set of instructions for an embroidery machine, for instance, to stitch the customized embroidery with the common strand of thread, or both (i.e., both the first set of instructions and the second set of instructions). Moreover, some embodiments include specifically allowing the user to change the embroidery instructions, for instance, including reapplying (e.g., changed or unchanged) instructions (e.g., of the color instructions).

Further, some embodiments include stitching the customized embroidery (e.g., for the user), for instance, using the planned pattern of stitches. In particular embodiments, for example, this may include printing the multiple different colors onto the common strand of thread (e.g., immediately) before the stitching of the customized embroidery (e.g., for the user). Still further, in some embodiments, the embroidery instructions are captured in a browser window, the embroidery engine is on a server, or both. Even further, in various embodiments, the first set of instructions for the thread printer, for example, to print the multiple different colors (e.g., onto the common strand of thread), for instance, before the stitching of the customized embroidery (e.g., for the user) includes: instructions for printing varying shades of the multiple different colors (e.g., along the common strand of the thread), instructions for printing at least one gradient of at least one color (e.g., along the common strand of the thread), instructions for printing a repeat of: a spot color sequence or a gradient transition, or a combination thereof, as examples. In certain embodiments, the planned pattern of stitches includes overlay stitches that are visible in the customized embroidery and underlay stitches that are hidden from view under overlay stitches. Further still, in certain embodiments, the underlay stitches are specifically not included in the at least one gradient. Even further still, in particular embodiments, the creating of the planned pattern of stitches from the embroidery instructions includes assigning the multiple different colors to stitch vectors in an embroidery design used for the stitching of the customized embroidery (e.g., for the user).

In some embodiments, the first set of instructions for the thread printer, for example, to print the multiple different colors (e.g., onto the common strand of thread), for instance, before the stitching of the customized embroidery (e.g., for the user) includes instructions for gradually fading from the start color to the end color. Still further, in particular embodiments, the first set of instructions, the second set of instructions, or both (e.g., combined) include instructions for gradually fading from the start color at the start location to the end color at the end location. Even further, in some embodiments, in the creating of the planned pattern of stitches from the embroidery instructions, determination of color of an intermediate stitch between the start location and the end location is based on a determined number of stitches between the start location and the end location, a determined number of stitches between the start location and the intermediate stitch, or both. Still further, in some embodiments, in the creating of the planned pattern of stitches from the embroidery instructions, determination of color of an intermediate stitch between the start location and the end location is based on a determined length of stitch vectors between the start location and the end location, a determined length of stitch vectors between the start location and the intermediate stitch, or both, as another example.

In particular embodiments, the multiple different colors of the color instructions include an intermediate color. Further, in certain embodiments, the first set of instructions for the thread printer to print the multiple different colors (e.g., onto the common strand of thread) before the stitching of the customized embroidery (e.g., for the user) includes instructions for: gradually fading from the start color to the intermediate color, gradually fading from the intermediate color to the end color, or both, as examples. Further, in certain embodiments, the (e.g., color) instructions include an intermediate location within the customized embroidery and the first set of instructions, the second set of instructions, or both, include instructions for: gradually fading from the start color at the start location to the intermediate color at the intermediate location, gradually fading from the intermediate color at the intermediate location to the end color at the end location, or both. Still further, in some embodiments, the planned pattern of stitches includes an outline design, for example, that includes multiple segments. Even further, in particular embodiments, the creating of the planned pattern of stitches from the embroidery instructions includes using shape, properties, or both, of each of the multiple segments. Still further, in some embodiments, the first set of instructions for the thread printer to print the multiple different colors (e.g., onto the common strand of thread) before the stitching of the customized embroidery (e.g., for the user) includes instructions for gradually fading from the start color to the end color. Even further still, in particular embodiments, a particular segment of the multiple segments includes both the start color and the end color, gradually fading from the start color to the end color takes place within the particular segment of the outline design, or both. Moreover, in certain embodiments, the first set of instructions for the thread printer to print the multiple different colors (e.g., onto the common strand of thread) before the stitching of the customized embroidery (e.g., for the user) includes instructions for gradually fading from the start color to the end color and a group of segments of the multiple segments includes the start color and the end color. In a number of embodiments, for example, gradually fading from the start color to the end color takes place across a plurality of the segments within the group of segments of the outline design. Further, in particular embodiments, gradually fading from the start color to the end color partially takes place (e.g., partially) within each of the plurality of the segments within the group of segments of the outline design.

Another specific embodiment is a computerized method of creating embroidery (e.g., for a user) that includes (e.g., using a computing device) capturing embroidery instructions (e.g., from the user), for example, in a browser window. In a number of embodiments, the embroidery instructions include color instructions, for example, identifying multiple different colors, for instance, including a start color, an intermediate color (e.g., one or more intermediate colors), and an end color. Further, some embodiments include receiving the embroidery instructions (e.g., including the color instructions) at an embroidery engine (e.g., on a server), creating a planned pattern of stitches (e.g., from the embroidery instructions), or both. Still further, some embodiments include stitching the embroidery (e.g., for the user), for example, using the planned pattern of stitches, for instance, including (e.g., gradually) fading color of the embroidery, for example, from the start color to the intermediate color, from the intermediate color to the end color, or both. For example, some embodiments include, outputting a first set of instructions for a thread printer to print the multiple different colors (e.g., onto a common strand of thread), for instance, before the stitching of the customized embroidery (e.g., for the user). In some embodiments, for example, the first set of instructions include instructions to (e.g., gradually) fade color, for instance, from the start color to the one or more intermediate colors, from the one or more intermediate colors to the end color, or both. Even further, some embodiments include outputting a second set of instructions for an embroidery machine to stitch the customized embroidery (e.g., with the common strand of thread).

Still another specific embodiment is a (e.g., computerized) method of creating (e.g., customized) embroidery (e.g., for a user), where the method includes (e.g., using a computing device) capturing embroidery instructions from the user (e.g., in a browser window), for example, the embroidery instructions including color instructions, for instance, including a start location, an end location, or both. Some embodiments further include receiving the embroidery instructions (e.g., including the color instructions) at an embroidery engine (e.g., on a server), creating a planned pattern of stitches (e.g., from the embroidery instructions), or both. Further, some embodiments include stitching the (e.g., customized) embroidery (e.g., for the user), for example, using the planned pattern of stitches, for instance, including (e.g., gradually) fading color of the (e.g., customized) embroidery, for example, from the start location, to the end location, or both. For example, some embodiments include outputting a first set of instructions for a thread printer to print (e.g., multiple different) colors (e.g., onto a common strand of thread), for instance, before stitching of the customized embroidery (e.g., for the user). Moreover, in some embodiments, the first set of instructions include instructions to (e.g., gradually) fade color (e.g., of the customized embroidery), for instance, from the start location to the end location. Even further, various embodiments include outputting a second set of instructions for an embroidery machine, for example, to stitch the customized embroidery (e.g., with the common strand of thread).

Other embodiments include (e.g., computer) systems and computer-readable storage media that contain computer-readable instructions that perform similar acts or communicate similar information. Many embodiments provide, for example, as objects or benefits, computer tools that, in whole or in part, create (e.g., customized) embroidery (e.g., for a user), for instance, using vectors. In addition, various other embodiments of the invention are also described herein, and other benefits of certain embodiments are described herein or may be apparent to a person of skill in this area of technology.

Figure 1:
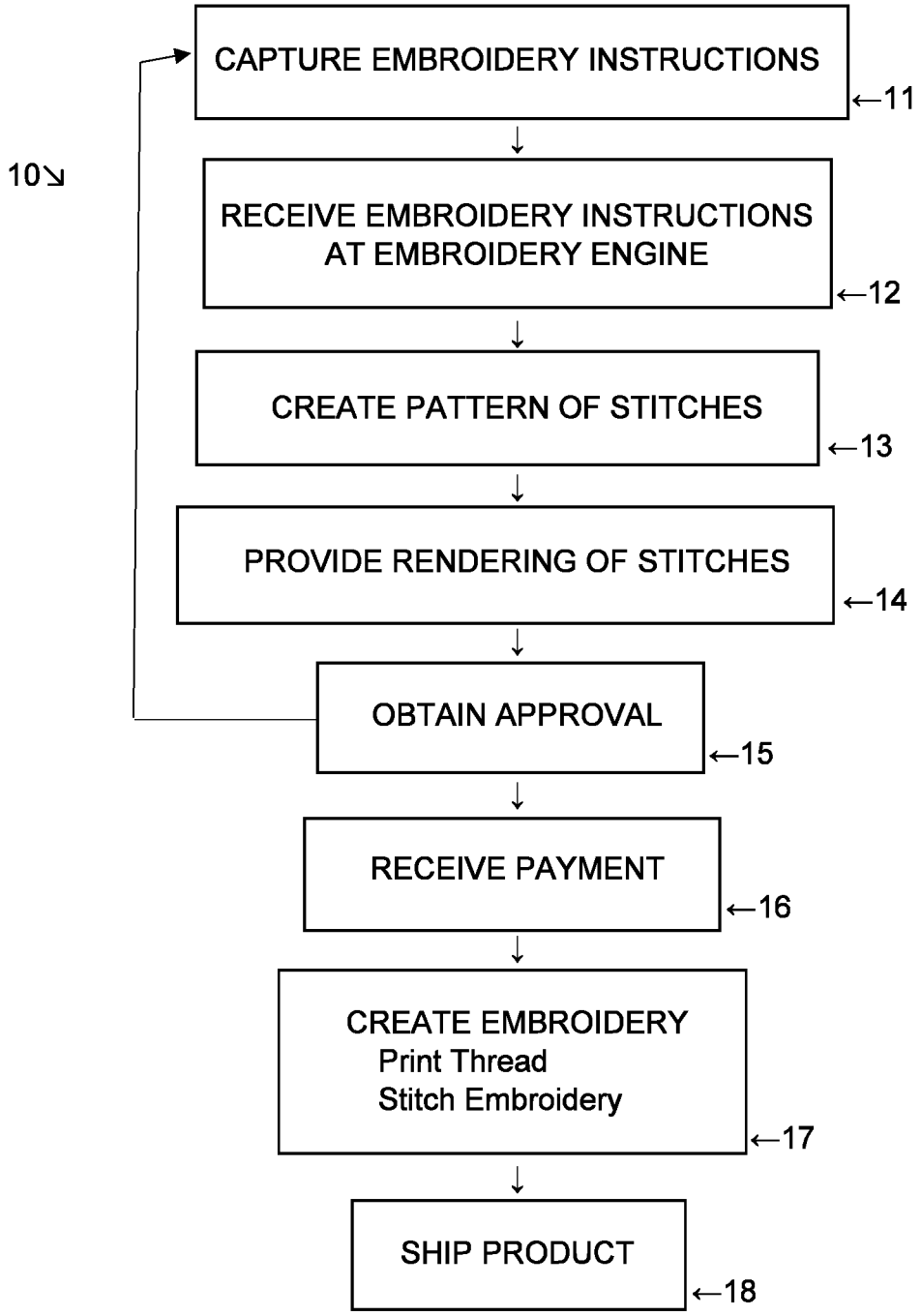
FIG. 1 is a flow chart illustrating an example of a (e.g., computer implemented) method of creating (e.g., customized) embroidery, for example, for a user.

The drawings provided herewith illustrate, among other things, examples of certain aspects of particular embodiments. Other embodiments may differ. Various embodiments may include aspects shown in the drawings, described in the specification (including the claims), known in the art, or a combination thereof, as examples.

DETAILED DESCRIPTION OF EXAMPLES OF EMBODIMENTS

This patent application describes, among other things, examples of certain embodiments, and certain aspects thereof. Other embodiments may differ from the particular examples described in detail herein. Various embodiments include (e.g., computerized) methods of creating (e.g., customized) embroidery, for example, including capturing embroidery instructions (e.g., in a browser window), receiving the instructions at an embroidery engine (e.g., on a server), creating a planned pattern of stitches, and outputting instructions for stitching the embroidery. In some embodiments, for example, the stitching of the embroidery includes, or the instructions for stitching of the embroidery include instructions for, for instance, printing color (e.g., the multiple colors) onto a (e.g., common) strand of thread (e.g., immediately) before stitching. In different embodiments, color may be printed in a gradient, for instance, or (e.g., gradually) faded, for example, from a start color to an end color, or from a start color to an intermediate color (e.g., and from the intermediate color to an end color). Further, in various embodiments, color may be (e.g., gradually) faded, for instance, from a start location to an end location or from a start location to an intermediate location (e.g., and from the intermediate location to an end location). some embodiments include multiple intermediate locations, intermediate colors, or both, as further examples. In a number of embodiments, varying shades of colors may be printed, patterns may be repeated, outlines, segments, or vectors may be used, or a combination thereof. Further, in certain embodiments, intermediate stitch color may be determined, for example, based on number of stitches or (e.g., vector) length, as examples.

Figure 2:
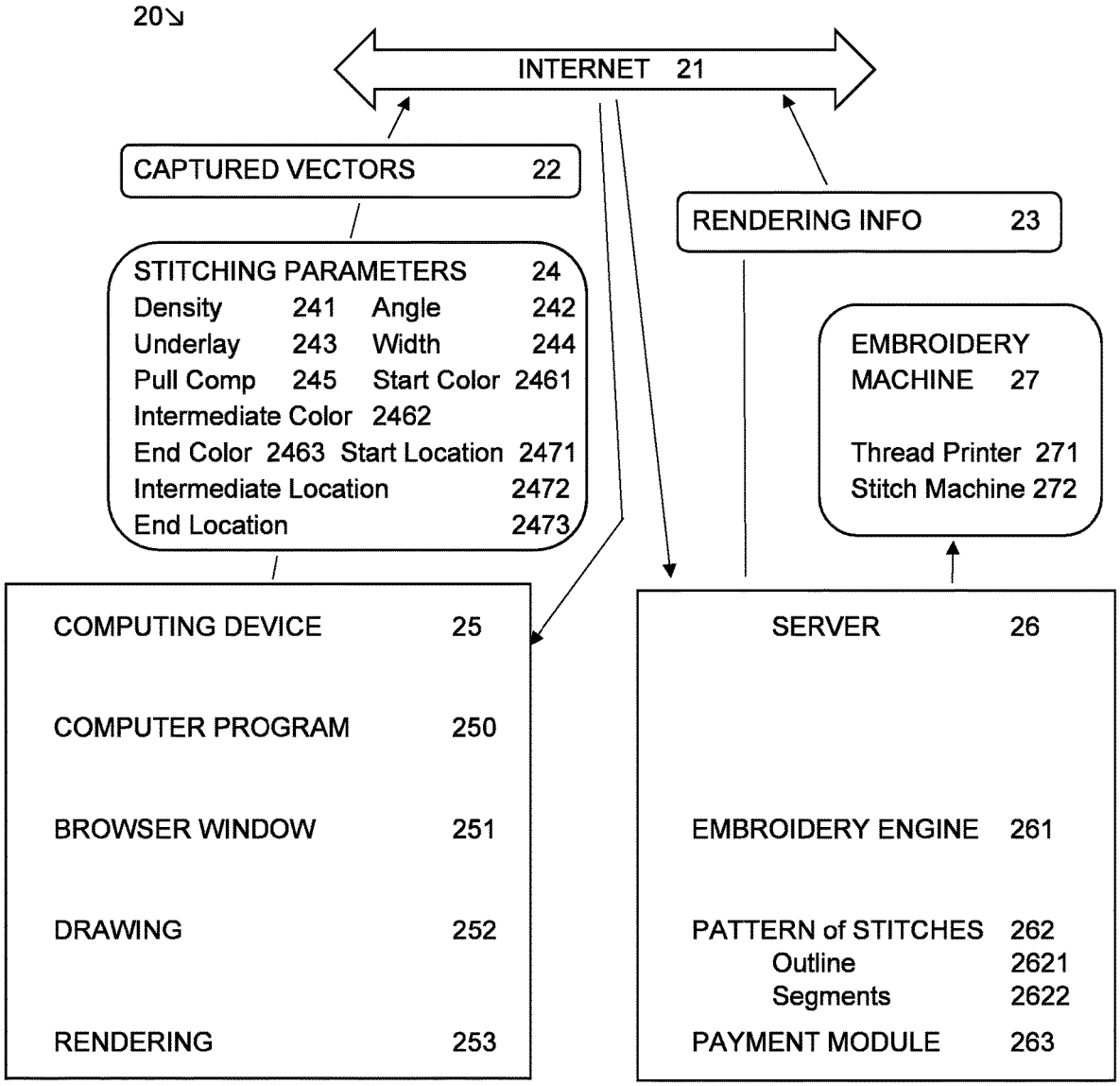
FIG. 2 is a block diagram illustrating an example of a system of creating (e.g., customized) embroidery, for example, that may be used to implement a method, for example, as shown in FIG. 1.
Figure 3:
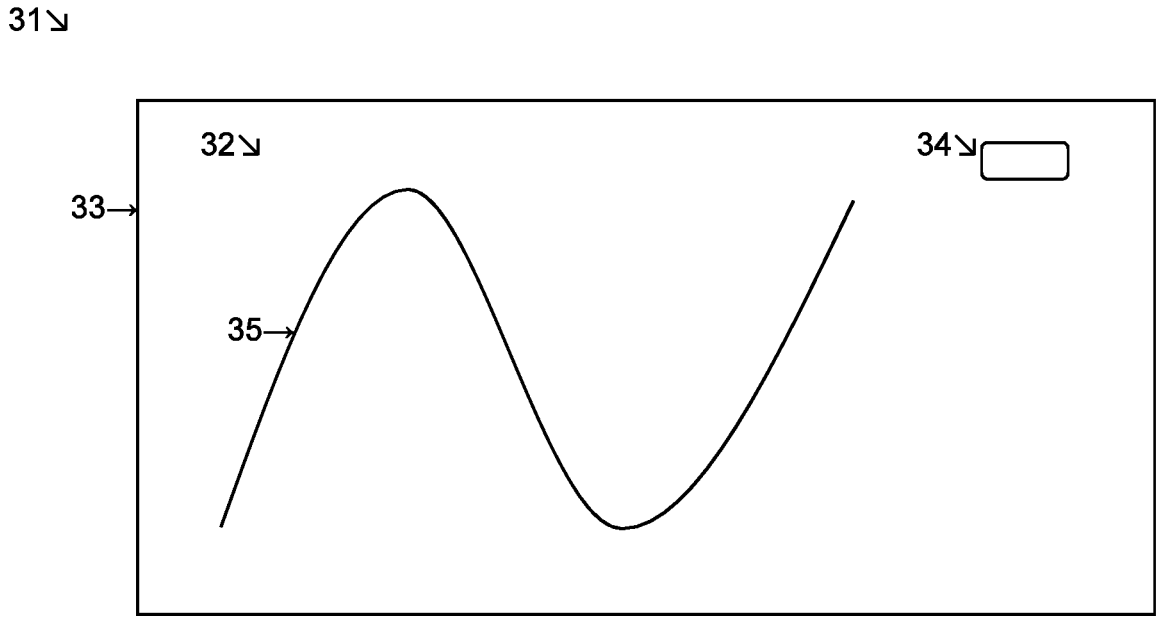
FIG. 3 is an example of a screen shot illustrating how embroidery instructions that include a drawing (e.g., from a user) can be captured, for instance, in a system or method of creating (e.g., customized) embroidery, for example, (e.g., in a browser window)

FIG. 1 illustrates, for example, (e.g., computer implemented) method 10 of creating (e.g., customized) embroidery, for example, for a user. Further, FIG. 2 illustrates system 20 that can be used, for example, to implement method 10. Still further, in the embodiment shown, method 10 includes (e.g., using computer or computing device 25 shown in FIG. 2) capturing (e.g., act 11 in FIG. 1) embroidery instructions (e.g., 252 shown in FIG. 2), for example, from the user, for instance, in browser window 251 shown in FIG. 2 or browser window 31 shown in FIG. 3. FIG. 3 illustrates how a drawing (e.g., 252 or 32), for instance, from a user, can be captured (e.g., in act 11, for instance, in browser window 251, 31, 51, or a combination thereof). In some embodiments, in a browser (e.g., browser window 251), the user is presented an area (e.g., 33 shown in FIG. 3) in which the user can freehand draw, for example, using an input device, such as a finger or stylus, for instance, on a touch screen or with a mouse (e.g., connected to, or in communication with, computing device 25). In certain embodiments, the area (e.g., 33), has a scale (e.g., in mm, cm, or both, or in inches, tenths of an inch, eighths of an inch, sixteenths of an inch, or a combination thereof), for example, across the top or bottom, a side, or a combination thereof, as examples. In the embodiment shown, area 33 or browser window 31 includes tool or icon 34 that the user can select to make the drawing (e.g., 252 or 32). Various embodiments have one or more tools (e.g., 34) that can be selected by the user, for example, in the top, side, or corner (e.g., upper right corner) of the browser window (e.g., 31) or area (e.g., 33). In some embodiments, such tools (e.g., 34) can be used (e.g., by the user) to select color, width (e.g., 44), stitch type (e.g., 49 or 46), or a combination thereof, as examples. In some embodiments, several different tools (e.g., 34) can be selected. In a number of embodiments, the embroidery instructions, for example, drawing (e.g., 252 or 32) is captured (e.g., in act 11) as (e.g., a first set of) captured vectors (e.g., 22). Further, in the embodiment shown, method 10 includes defining, receiving, or transmitting (e.g., act 12), for instance, embroidery instructions, for example, including the first set of captured vectors (e.g., 22). Still further, in a number of embodiments, the method (e.g., 10) or act (e.g., 11 or 12) further includes capturing (e.g., in act 11), defining or receiving (e.g., in act 12, at server 26, or both), or transmitting (e.g., from computing device 25, for instance, desired) stitching parameters (e.g., 24), for instance, received (e.g., in act 12) at an embroidery engine (e.g., 261), for instance, on a server (e.g., 26). In a number of embodiments, an embroidery engine (e.g., 261) is software which takes as input shapes, for example, vector shapes, stitching parameters, or both, for instance. Further, in various embodiments, an embroidery engine (e.g., 261) generates (e.g., in act 13) and returns a pattern of stitches (e.g., vectors), for instance, based on the input (e.g., vector) shape, stitch parameters, or both.

Various embodiments include transmitting, receiving, or both, (e.g., in act 12) embroidery instructions (e.g., captured in act 11), for example, captured vectors (e.g., 22, for example, defined in act 12) along with (e.g., desired) stitching parameters (e.g., 24) to an embroidery engine (e.g., 261), for instance, on a server (e.g., 26). Some embodiments further include having the embroidery engine (e.g., 261), or the server (e.g., 26) create stitches (e.g., in act 13) from those vectors (e.g., 22) and parameters (e.g., 24). FIG. 2 shows computing device 25 sending captured vectors 22 and stitching parameters 24 to embroidery engine 261, for example, on server 26 via Internet 21, for example. In a number of embodiments, once the strokes have been drawn (e.g., captured in act 11 in browser window 31), the vectors or strokes (e.g., captured vectors 22) are (e.g., defined and) sent, for example, (e.g., in act 12) to the server (e.g., 26, for instance, specifically to embroidery engine 261, or received there) to be converted (e.g., in act 13) to embroidery (e.g., pattern of stitches 262 or rendering info 23), at the width (e.g., 244) specified (e.g., by the user, for instance, in stitching parameters 24). Further still, method 10 further includes creating (e.g., in act 13) a (e.g., planned) pattern of stitches (e.g., 262), for example, from the first set of captured vectors (e.g., 22, for instance, received or defined in act 12) and the (e.g., desired) stitching parameters (e.g., 24). Various processes of creating stitches (e.g., act 13), for instance, performed by the embroidery engine (e.g., 261), for example, on the server (e.g., 26) are complex, for example, requiring many lines of source code (e.g., within embroidery engine 261) but are known in the art and available for license from multiple sources, for example.

In the embodiment shown, the creating (e.g., in act 13 in FIG. 1) of the (e.g., planned) pattern of stitches (e.g., 262 shown in FIG. 2), for example, from first set of captured vectors 22 and desired stitching parameters 24, is performed at server 26, for example, and (e.g., desired) stitching parameters 24 are captured (e.g., in act 11) or defined (e.g., in act 12) using computing device 25, for instance, owned, operated, or both, by the user. In various embodiments, computing device 25 may be a desktop computer, laptop computer, tablet computer, smart phone, or machine controller device (e.g., a device controlling an embroidery machine, for instance, embroidery machine 27 shown in FIG. 2) as examples, and a person of ordinary skill in the art would be able to select a suitable computing device. Further, in the embodiment shown, the capturing of the drawing or embroidery instructions (e.g., in act 11, for instance, in browser window 251 or 31, for example, drawing 252 or 32), for instance, as the (e.g., first set of) captured vectors (e.g., 22), specifically does not include capturing the drawing (e.g., 252 or 32) as a bitmap. In various embodiments, capturing the drawing (e.g., 252 or 32) as a bitmap is not necessary (e.g., in act 11). A bitmap is an image which is a rendering (e.g., a picture) of the embroidery design. In contrast, in various embodiments, a pattern of stitch vectors is a list of the actual x and y movements or vectors that are sent to the embroidery machine (e.g., 27) to create the stitches. Various embodiments specifically include capturing (e.g., in act 11) a drawing (e.g., 252 or 32), for instance, in a browser window (e.g., 251 or 31) as vectors (e.g., captured vectors 22), for example, rather than as a bitmap.

Figure 4:
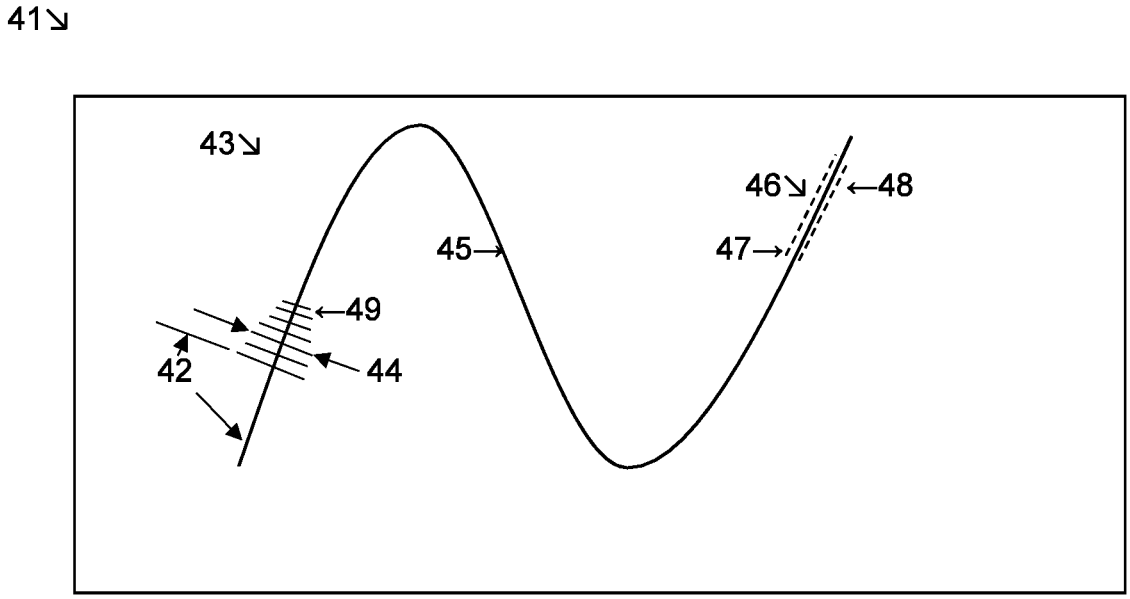
FIG. 4 is an example of a screen shot illustrating an example of a rendering (e.g., for inspection by the user) of a planned pattern of stitches (e.g., in a browser window) of a system or method, for instance, of creating (e.g., customized) embroidery, for example.

In certain embodiments, vectors (e.g., 22) are created in a web browser session (e.g., in browser window 251) for example, by importing the vectors (e.g., 22) from a file. Further, in particular embodiments, a drawing is created in a desktop application (e.g., rather than in, or not just in, a browser, for example, connected to a server). In particular embodiments, for example, a desktop, tablet, phone, as examples, is not necessarily connected to a server. Instead, in certain embodiments, the embroidery engine is local to the computing device. Different embodiments include (e.g., in act 11, for instance, by the user) drawing one or more vector paths (e.g., 35 shown in FIG. 3), importing one or more vector paths (e.g., 35) from a file, or pasting one or more vector paths (e.g., 35) from a memory clipboard (e.g., Ctrl-C, Ctrl-V), or a combination thereof, as examples. Further still, some embodiments include (e.g., the user) editing those one or more vector paths (e.g., 35). FIGS. 3 and 4 show vector paths 35 and 45 that may have the same shape. Vector path 35 may have been drawn (e.g., by the user), for example, into browser window 31. Vector path 45 may be the same or similar to vector path 35 and may be used (e.g., by embroidery engine 261) to create (e.g., in act 13) the pattern of stitches (e.g., 262). Although vector path 45 is shown for illustration purposes in FIG. 4, in some embodiments, the vector path is not shown in the rendering of the stitches (e.g., provided in act 14, within rendering 253, or within rendering info 23). Further, although stitches 49 and 46 are only shown along part of vector path 45 in FIG. 4, stitches may often extend the entire length of the vector path. Further still, stitches are shown separated or spaced apart in FIG. 4, but in a number of embodiments, stitches may be much closer together (e.g., more densely spaced, i.e., density 241, for instance, partially or fully touching, or even overlapping).

In the embodiment shown, method 10 of FIG. 1 includes defining, returning, or providing (e.g., in act 14) a rendering (e.g., within rendering info 23, or rendering 253) of the (e.g., planned) pattern of stitches (e.g., 262). Some embodiments, for instance, include providing (e.g., in act 14), for instance, to the browser or browser window (e.g., 251, 31, or 41), the (e.g., planned) pattern of stitches (e.g., 262), for example, for inspection by the user. In particular embodiments, for example, the returning of the rendering of the planned pattern of stitches (e.g., 262) to the browser (e.g., 251) for inspection by the user (e.g., in act 14) includes specifically returning a bitmap, for example, of the (e.g., planned) pattern of stitches (e.g., 262) to the browser (e.g., 251, for instance, in window 31 or 41) for inspection by the user. Even further, the embodiment shown can include (e.g., in act 14) returning a second set of rendering vectors (e.g., within rendering info 23), for example, to browser 251, 31, or 41, for example, for drawing the (e.g., planned) pattern of stitches (e.g., 262), for instance, in browser 251, 31, or 41, for instance, for inspection by the user (e.g., for rendering 253 or 43). Even further still, in some embodiments, the second set of rendering vectors (e.g., of rendering info 23) includes, for example, many hundreds or thousands of individual rendering vectors, for instance, representing (e.g., planned) pattern of stitches 262. In some embodiments, the user clicks a button (e.g., a check mark in the lower left corner), for instance, of the browser window (e.g., 31) to initiate acts 13 and 14 of creating the pattern of stitches (e.g., 262) and providing the rendering (e.g., 43). Further, in particular embodiments, the rendering (e.g., 43) is identified as such (e.g., as a "result"), for instance, in browser window 41.

Moreover, in method 10, the capturing (e.g., in act 11) of the embroidery instructions, creative work, or drawing (e.g., 252 or 32), for instance, in the browser window (e.g., 251 or 31) includes capturing a freehand drawing (e.g., that is drawn by the user, for instance, in the browser window, for instance, 251 or 31), capturing calligraphy, writing, or handwriting (e.g., that is written by the user, for example, in the browser window, for instance, 251 or 31), capturing a signature (e.g., that is written by the user, for instance, in the browser window, for instance, 251 or 31), or a combination thereof. Drawings 252 and 32 are examples shown in FIGS. 2 and 3 respectively. Furthermore, in method 10, the (e.g., defining or receiving, for instance, receiving at server 26, for example, in act 12) of the embroidery instructions, for example, first set of captured vectors (e.g., 22) and (e.g., desired) stitching parameters (e.g., 24), for instance, received at embroidery engine 261, for example, on server 26, includes receiving a (e.g., desired) angle (e.g., 242 shown in FIG. 2 or 42 shown in FIG. 4) of the stitches (e.g., stitches 49 of rendering 43), receiving a desired width (e.g., 244 or 44) of the stitches (e.g., 49), or both, for example. FIG. 4 illustrates a screen shot that shows rendering 43 (e.g., for inspection by the user) of a (e.g., planned) pattern of stitches (e.g., 262), for example, in browser window 41. Browser window 41 may be the same or similar to browser window 251, 31, or both, in some embodiments. Further, rendering 43 in FIG. 4 or as described herein may be the same as rendering 253 in FIG. 2. Various embodiments include returning (e.g., in act 14) a rendering (e.g., within rendering info 23, for instance, rendering 43 or 253) of the created (e.g., in act 13) stitches (e.g., 49, 46, or both, shown in FIG. 4) to the browser (e.g., browser window 251, 31, or 41) for inspection/viewing by the user, and/or returning thousands of vectors (e.g., rendering info 23) to the browser (e.g., of browser window 251, 31, or 41) in order to draw (e.g., in act 13 or 14), for instance, high quality stitching (e.g., stitches 49, 46, or both) in the browser (e.g., 41).

Many embodiments include passing or receiving (e.g., in act 12) the vector path (e.g., 35), for instance, via captured vectors (e.g., 22), for instance, along with the desired attributes of the resulting stitches (e.g., stitching parameters 24) to the embroidery engine (e.g., 261). In various embodiments, the attributes (e.g., stitching parameters 24) include (e.g., desired) angle (e.g., 242 or 42) of the stitches (e.g., 49). In some embodiments, the stitch angle (e.g., 242 or 42) is orthogonal to the vector path (e.g., 45) or the stitches (e.g., 49) are 90 degrees to the path (e.g., 45). Further, in some embodiments, the stitch angle (e.g., 242 or 42) is relative to the vector path (e.g., 45) at the stitch (e.g., of stitches 49), and turns as the path turns, but in other embodiments, the stitch angle (e.g., 242 or 42) is a fixed angle, for instance, 135 degrees (e.g., from vertical or from horizontal), and thus, simulates the look of a calligraphy pen. In some embodiments, the stitch angle (e.g., 242 or 42) is selected by the user (e.g., in act 11, browser window 251, or both). Still further, in some embodiments, whether the stitch angle (e.g., 242 or 42) is relative to the vector path (e.g., 45) at the stitch (e.g., 49), or is a fixed angle is selectable by the user. In various embodiments, the user is prompted to make a selection (e.g., for stitching parameters 24).

Further, in various embodiments, the embroidery instructions or the attributes (e.g., stitching parameters 24) include various (e.g., desired) embroidery settings, such as underlay type (e.g., 243), density (e.g., 241), pull compensation (e.g., 245), or a combination thereof, as examples. Still further, some embodiments, display (e.g., in act 14 or in a rendering, for instance, 43) a fabric image, for example, to match a (e.g., desired) target fabric (e.g., defined in act 11 or 12 or within stitching parameters 24). The fabric can be chosen either by the user (e.g., in act 11) or by the web site host (e.g., via embroidery engine 261), in various embodiments. Moreover, various embodiments allow (e.g., within stitching parameters 24) for the selection (e.g., in act 11) of a thread color, for example, from a pallet of threads defined by the web site host (e.g., via embroidery engine 261). In some embodiments, one or more such attributes are selectable by the user. In various embodiments, the user is prompted (e.g., at computing device 25 or browser window 251 or 31) to make a selection (e.g., for stitching parameters 24).

In some embodiments, for example, in method 10, after the rendering (e.g., 43) of the stitches (e.g., 49 and 46) is provided (e.g., in act 14), approval (e.g., of rendering 43) is obtained or requested (e.g., act 15), for instance, from the user. Once the rendering is approved (e.g., in act 15), in certain embodiments, the user may be prompted (e.g., through browser window 251) to select and pay for a product (e.g., garment) containing the embroidery. Payment (e.g., from the user) may be received (e.g., in act 16), for instance, in various embodiments, by credit card or another payment method (e.g., via Internet 21, payment module 263, or both). Once payment is obtained (e.g., in act 16), in some embodiments, the embroidery may be created (e.g., in act 17) and, in various embodiments, the product may be shipped (e.g., in act 18), for example, to the user, for instance, by mail. In certain embodiments, when the user is satisfied with the result (e.g., rendering 43, for instance, provided in act 14), the user grants approval or submits the order (e.g., obtained in act 15). The drawn strokes (e.g., rendering info 23, or of rendering 43) are stored on a server (e.g., 26) in some embodiments. The stitches (e.g., 49, 46, or both) can be recreated, in particular embodiments, from the strokes (e.g., of act 11, captured vectors 22, stitching parameters 24, or a combination thereof), and can be re-purposed, in some embodiments, for example, for various desired target fabrics, using settings appropriate to the target fabric. Further, in particular embodiments, the resulting stitches (e.g., 49, 46, or both), for instance, from the web session with the user (e.g., provided in act 14) are stored, for instance, on the server (e.g., 26).

Further, various embodiments include computer programs (e.g., 250 shown in FIG. 2), for example, that include computer-readable instructions which, when executed by the computing device (e.g., 25), cause the computing device to perform certain acts (e.g., of method 10). In some embodiments, for example, such acts include capturing (e.g., act 11) embroidery instructions, for example, a drawing (e.g., 252 or 32, for instance, from a user), for example, as (e.g., a first set of) captured vectors (e.g., 22), and transmitting or receiving (e.g., act 12) the (e.g., first set of) captured vectors (e.g., 22) and (e.g., desired) stitching parameters (e.g., 24), for example, to or at an embroidery engine (e.g., 261), for instance, on a server (e.g., 26). Still further, some embodiments include defining or selecting (or both), for example, from a pre-defined color transition. Further still, in many embodiments, such acts include displaying (e.g., act 14) a rendering (e.g., 43) of a (e.g., planned) pattern of stitches (e.g., created in act 13), for example, for inspection by the user. Still further, in a number of such embodiments, the (e.g., planned) pattern of stitches (e.g., in rendering info 23) has been created (e.g., in act 13) from the (e.g., first set of) captured vectors (e.g., 22) and the desired stitching parameters (e.g., 24), for example. Even further, in particular embodiments, the computer program (e.g., 250) further includes computer-readable instructions which, (e.g., when executed by the computing device, for instance, 25), cause the (e.g., computing device 25) to draw (e.g., in act 13 or 14) the (e.g., planned) pattern of stitches (e.g., 262 or rendering 43) for inspection by the user, for instance, using (e.g., a second set of) rendering vectors (e.g., within rendering info 23) returned to the computing device (e.g., 25) from the embroidery engine (e.g., 261), for example, on the server (e.g., 26). If the rendering (e.g., 43) is not approved (e.g., in act 15), in some embodiments, the user may be allowed to change the embroidery instructions, for example, the drawing (e.g., 32 or 252), stitching parameters (e.g., 24), or both, and a new rendering (e.g., 43) may be provided. Moreover, some embodiments include allowing the user (e.g., in act 11 to 14) to change the embroidery instructions (e.g., captured in act 11) including, in certain embodiments, reapplying (e.g., in act 13) unchanged instructions (e.g., captured in act 11), for instance, of the color instructions. For example, in a number of embodiments, the user can change size or stitch type (e.g., of all or part of the drawing) and the system will automatically recalculate the stitches while maintaining the same color or color gradient (i.e., where the user has not changed the color instructions). In various embodiments, however, changed instructions (e.g., changed color instructions) can be applied (e.g., changed by the user). Even further still, in certain embodiments, the computer program (e.g., 250) includes computer-readable instructions which, when executed by the computing device (e.g., 25), cause the computing device to draw the (e.g., planned pattern of stitches e.g., 262 or rendering 43) for inspection by the user using a recipe that includes multiple parameters based on a type of fabric (e.g., selected by the user).

Some embodiments include color or color transitions, for example. In a number of embodiments, for instance, color is printed (e.g., in act 17, by printer 271, or both) onto "blank" (e.g., white) thread. In some embodiments, dying machine or thread printer 271 may operate in conjunction with, or be part of, embroidery machine 27. In some embodiments, the color is printed in various shades, along a length of the cone of the thread, or both, as examples. Further, in various embodiments, gradients of color (e.g., from one color to another) are created, for example, along the thread. As used herein, a gradient of color occurs when color change along a length of thread sufficient to form at least three (3) stitches. Still further, in some embodiments, colors are assigned (e.g., in act 13) to a set of stitch vectors in an embroidery design or planned pattern of stitches (e.g., 262). Even further, in particular embodiments, the stitch vectors or colors are output (e.g., in act 17), for example, to a digital thread printer (e.g., 271). In various embodiments, for example, the stitch vectors or colors are data that the printer (e.g., 271) needs or uses to print the thread (e.g., in act 17) in the desired colors, for instance, to match the stitches (e.g., created in act 13 or in planned pattern of stitches 262). Various embodiments include outputting (e.g., in act 17) a first set of instructions for a thread printer (e.g., 271) to print, for example, the multiple different colors, for instance, onto a common strand of thread, for example, before the stitching of the customized embroidery (e.g., in act 17), for instance, for the user. Even further still, certain embodiments include outputting (e.g., in act 17) a second set of instructions, for example, for an embroidery machine (e.g., 272), for instance, to stitch the customized embroidery (e.g., in act 17), for example, with the common strand of thread.

In some embodiments, embroidery outlines (e.g., 2621 shown in FIG. 2) are used, for example, in act 12, 13, 14, 17, or a combination thereof. Outlines (e.g., 2621) may be or include a higher level set of vectors, properties, or both, in some embodiments, that may define shapes to be filled with stitches, for example, according to the shape of the vectors and their associated properties. Further, in certain embodiments, outline (e.g., 2621) designs are made up of a number of segments (e.g., 2622). For example, a set of satin stitches may be created (e.g., in act 13), in particular embodiments, by drawing an outline (e.g., 2621) shape of a desired set of stitches (e.g., according to embroidery instructions captured in act 11) and assigning properties, which may include, as examples, lines defining stitch angles at various points in the shape, numerical values for the distance between the stitches (or density of the stitches), parameters for the type of underlay stitching, pull compensation that may be different for each kind of fabric on which the embroidery is stitched, a combination thereof, as examples, or more. In certain embodiments, all of this information together may be one segment of an outline design (e.g., 2621, created in act 13, or both).

In a number of embodiments, actual stitch vectors to be performed by a stitching machine or an embroidery machine (e.g., 272, 27, in act 17, or a combination thereof) are generated (e.g., in act 13) by software. In various embodiments, stitching machine 272 may operate in conjunction with, or be part of, embroidery machine 27. In some embodiments, such stitch vectors may be generated (e.g., in act 13) from the outlines (e.g., 2621), for example, using the shape and properties of each segment (e.g., 2622) to guide the software or stitch engine on how to create the resulting stitches. Further, in various embodiments, the generated stitches may change, for example, each time any of the properties of the segments (e.g., 2622) change (e.g., via new embroidery instructions captured in act 11). For example, (e.g., the user) changing the size of the segment (e.g., 2622), or in some embodiments, a selection of multiple segments, or in particular embodiments, the entire design. Further examples include editing the shape (e.g., by moving points) or editing the underlay or density property. Various changes may change (e.g., in act 13) the generated stitches. Various embodiments allow the user to change the embroidery instructions. Still further, in a number of embodiments, when the user changes the embroidery instructions, the system maintains or reapplies previous unchanged instructions, for example, unchanged color instructions.

Figure 5:
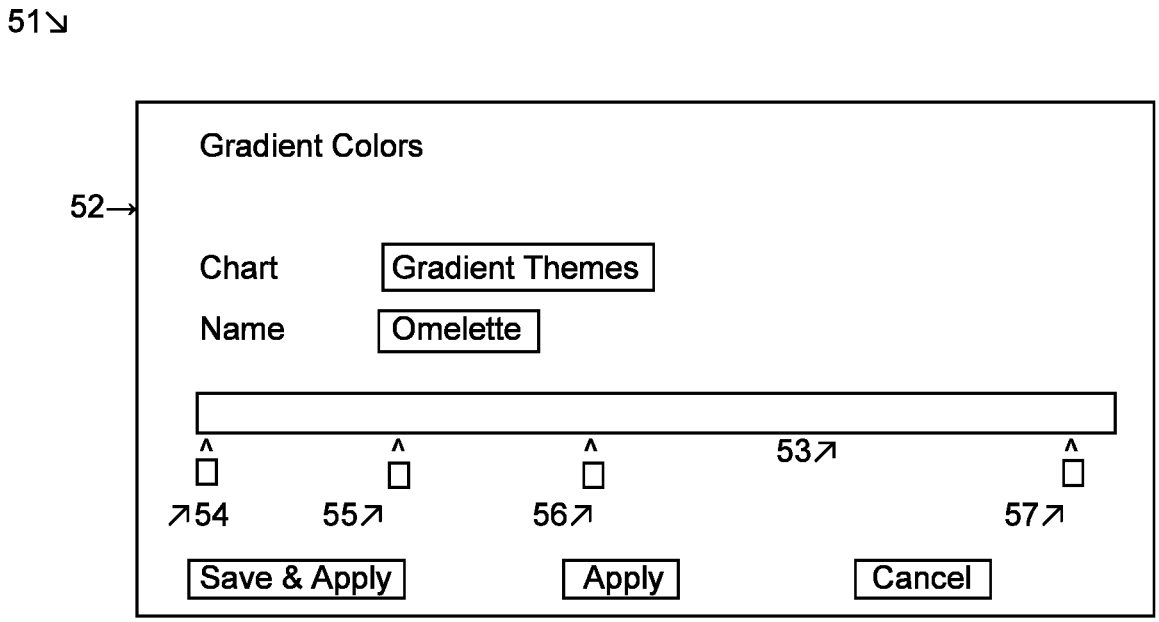
FIG. 5 is an example of a screen shot illustrating how color information (e.g., from a user) can be captured, for instance, in a system or method of creating (e.g., customized) embroidery, for example, (e.g., in a browser window).

In some embodiments, each segment (e.g., 2622) is a single color, assigned to a single thread, or both. In certain embodiments, for example, if the artist or user creating the embroidery design (e.g., captured in act 11) desired the color to change inside of a part of a design, the design would be split at that point in order for a new thread to be used. In a number of embodiments, however, a color gradient can be created (e.g., captured in act 11) by the designer (e.g., user). In some embodiments, for example, the designer defines (e.g., in act 11) a start color, an end color, or both. FIG. 5 illustrates an example of a browser window, 51, in which a user can input (e.g., in act 11) color information. Further, where a browser window (e.g., 51) is described herein, in other embodiments, the window may be a window in a desktop application, tablet application, phone application, or broadly an application on a computing device, as examples. This color information may include a start color (e.g., 2461 shown in FIG. 2 or 54 shown in FIG. 5), an end color (e.g., 2463 or 57), or both. Further, in various embodiments, the software will create (e.g., in act 13) a (e.g., gradual) fading of one color (e.g., 2461 or 54), into the other (e.g., 2463 or 57). Furthermore, in particular embodiments, additional (e.g., intermediate) colors (e.g., 2462, 55, 56, or a combination thereof) can be added to the sequence, for example, so that the sequence is defined by starting in color A (e.g., 2461 or 54), fading to B (e.g., 2462 or 55), then fading to C (e.g., 2463 or 56), etc. (e.g., 57).

Furthermore, the "duration" of the fade can be defined, in some embodiments, for example, so that if the entire gradient sequence is thought of as 100 percent, the designer (e.g., user) can define (e.g., in act 11, for instance, by moving slider 53) that the fade from A (e.g., 54) to B (e.g., 55) is 50 percent, then B (e.g., 55) to C (e.g., 56) is 20 percent then C (e.g., 56) to D (e.g., 57) is the remaining 30 percent, for example. In the embodiment shown, slider 53 displays a range of colors that the user can select from by selecting a particular location along slider 53. In particular embodiments, a number of gradient patterns can be defined (e.g., in act 11, browser 51, or both), named and saved. In certain embodiments, for example, a segment (e.g., 2622), or a group of segments, is selected. A gradient pattern can then be assigned to this segment or group of segments. In some embodiments, for example, as a stitch vector is generated (e.g., in act 13), for instance, according to the properties of the outline segment (e.g., 2622), a color is defined for that stitch vector, for instance, by referring to the gradient pattern (e.g., captured in act 11, browser window 51, or both) and determining how far along the sequence of the pattern this stitch is. In some embodiments, for example, this determination is based on how many stitches are going to be generated in the selection of segments (e.g., 2622). In some embodiments, however, this determination is based on the total length of the stitch vectors generated in the selection of segments. This may include, for example, calculating (e.g., in act 13) where this length of stitch vector belongs in the assignment of the gradient pattern to the total length of stitch vectors.

In certain embodiments, if the segment or group of segments (e.g., 2622) has underlay stitches (i.e., stitches which are hidden from view, for example, under other stitches, but are needed to, for example, stabilize the fabric in preparation for the visible stitches), then those stitches are assigned (e.g., in act 13) a single solid color, for example, so as not to impact the visible gradient of the overlay stitching. Further, in some embodiments, if a group of segments (e.g., 2622) is selected (e.g., rather than just a single segment), then stitches connecting the segments may be generated (e.g., in act 13) and a color may be assigned (e.g., in act 13) to those connecting stitches as well, for example, not impacting the creation of the gradient (e.g., as with underlay stitches in certain embodiments). Various features described herein, however, are not necessarily found in all embodiments.

In various embodiments, if properties of a segment (e.g., 2622) are changed (e.g., the shape, or settings for density, pull compensation, fill pattern, or many more, for instance, by the user, for example, in act 11), then the stitch vectors are re-generated (e.g., in act 13) and the gradient pattern may be re-calculated and re-applied. Further still, in some embodiments, the data of the resulting stitch vectors with their associated color information are compiled together (e.g., in act 13) to create the (e.g., digital) data needed (e.g., by printer 271, in act 17, or both) to print (e.g., a single cone of thread, in act 17, or both) containing the colors (e.g., captured in act 11), for example, in sequence, for instance, corresponding to the stitch data. This data (e.g., created in act 13) may include, in a number of embodiments, the total thread length for the gradient, the positions within that length of each color, or both, as examples. Even further, various embodiments are able to make transitions of colors. Some embodiments provide color gradients (e.g., as described herein) and some provide a repeat of either a spot color sequence or a repeat of a gradient transition, as examples. Some embodiments can provide a combination of these. An example of a spot color sequence is a red/white transition within 20 cm of threads and repeat. As used herein, a color gradient is a particular type of a color transition. Even further, in particular embodiments, the first set of instructions for the thread printer (e.g., 271), for example, to print the multiple different colors, for instance, onto the common strand of thread, for example, before the stitching (e.g., in act 17) of the customized embroidery (e.g., for the user) includes instructions for printing a repeat of, as examples, a spot color sequence, a gradient transition, or both.

As discussed, various embodiments are or concern (e.g., computerized) methods and software for creating (e.g., customized) embroidery. Some embodiments include importing existing artwork (e.g., not just drawn by the user). Further, some embodiments include using text tools, for example, embroidery text tools, for instance, where the letters are outline shapes, for example, with predefined embroidery stitch parameters, for instance, such as angle lines. Still further, some embodiments, use (e.g., standard) computer text tools, for example, True Type Fonts (TTF), for instance, where the outline shapes are imported from the TTF, then embroidery stitch parameters are applied, or both. Embodiments include (e.g., in act 11) capturing a drawing (e.g., from a user), for instance, in a browser window (e.g., 251), (or desktop, tablet, or phone application, in various embodiments) for example, as captured vectors, transmitting, receiving (e.g., in act 12), or using (e.g., in act 13) the captured embroidery instructions or vectors and, in many embodiments, desired stitching parameters (e.g., at an embroidery engine, for example, 261, for instance, on a server, for example, 26), and creating (e.g., in act 13) a (e.g., planned) pattern of stitches (e.g., 262), for example, from the embroidery instructions, captured vectors, desired stitching parameters, or a combination thereof. Some embodiments include transmitting, returning, receiving, or creating a rendering of the (e.g., planned) pattern (e.g., 262) of stitches (e.g., in act 14), for example, to the browser, or in certain embodiments, transmitting, receiving, returning, or creating rendering vectors (e.g., to the browser), for example, for drawing the (e.g., planned) pattern of stitches (e.g., in the browser), for instance, for inspection (e.g., by the user). In various embodiments, the embroidery instructions (e.g., of act 11) or drawing can include a freehand drawing, calligraphy, writing, handwriting, a signature, or a combination thereof, for example, that is drawn or (e.g., calligraphically) written by the user (e.g., in the browser window, for instance, 251). As further examples, some embodiments include importing existing artwork, typing embroidery text or vector-based text, such as TTF, or a combination thereof. In some embodiments, the (e.g., desired) stitching parameters (e.g., of act 11) can include angle, width, underlay type, density, pull compensation, or a combination thereof (e.g., recipe, for instance, based on fabric), for example, of the stitches.

Different embodiments include various (e.g., computerized) methods of creating (e.g., customized) embroidery, for example, for a user. In a number of embodiments, for instance, the method includes (e.g., at least) various acts. In various embodiments, for example, a method (e.g., 10) of creating embroidery includes at least acts of capturing embroidery instructions (e.g., act 11), receiving (e.g., in act 12) the embroidery instructions at an embroidery engine (e.g., 261), creating (e.g., in act 13) a planned pattern of stitches (e.g., 262), and stitching (e.g., in act 17) the embroidery. In particular embodiments, for example, a (e.g., computerized) method (e.g., 10) of creating (e.g., customized) embroidery (e.g., for a user) includes (e.g., using a computing device, for instance, 25) capturing embroidery instructions (e.g., in act 11, for instance, from the user), for example, in a browser window (e.g., 251). Further, in a number of embodiments, the embroidery instructions (e.g., captured in act 11) specifically include color instructions, for example, identifying multiple different colors (e.g., of the user-desired embroidery). Stitching parameters (e.g., 24 shown in FIG. 2), for instance, captured in act 11, may include color instructions, for example. Still further, various embodiments include receiving (e.g., in act 12) the embroidery instructions (e.g., including the color instructions) for instance, at an embroidery engine (e.g., 261, for instance, on server 26). Even further, various embodiments include creating (e.g., in act 13) a planned pattern of stitches (e.g., 262), for example, from the embroidery instructions (e.g., captured in act 11). Further still, in a number of embodiments, the method (e.g., 10) includes stitching (e.g., in act 17) the (e.g., customized) embroidery (e.g., for the user), for instance, using the planned pattern of stitches (e.g., 262, created in act 13, or both). In some embodiments, the stitching, for example, includes printing (e.g., in act 17, with printer 271, or both) the (e.g., multiple different) colors (e.g., captured in act 11, for example, printing onto a common strand of thread), for instance, (e.g., immediately) before the stitching (e.g., in act 17) of the (e.g., customized) embroidery (e.g., for the user). In this context, as used herein, "immediately before" means less than an hour before. In various embodiments, the (e.g., common strand of) thread is printed (e.g., colored) within 45, 30, 15, 10, 5, 4, 3, 2, 1, ½, or ¼ minutes before the thread is stitched into the embroidery, as examples. In some embodiments, the (e.g., common strand of) thread is printed (e.g., colored) in the moments before stitching, or as the thread is fed into the stitching machine, as examples.

In some embodiments, the printing (e.g., in act 17, with printer 271, or both) of the (e.g., multiple different) colors (e.g., onto the common strand of thread) includes printing the multiple different colors along a cone of the thread. Further, in certain embodiments, the printing (e.g., in act 17, with printer 271, or both) of the multiple different colors (e.g., onto the common strand of thread) includes printing varying shades of the multiple different colors (e.g., identified in act 11), for example, along the common strand of the thread. In particular embodiments, for example, the first set of instructions for the thread printer (e.g., 271), for example, to print the multiple different colors onto the common strand of thread, for instance, before the stitching (e.g., in act 17) of the customized embroidery for the user, includes instructions for printing varying shades of the multiple different colors, for example, along the common strand of the thread. Still further, in particular embodiments, the printing (e.g., in act 17, with printer 271, or both) of the multiple different colors (e.g., onto the common strand of thread) includes printing (e.g., at least one) gradient, for instance, of at least one color (e.g., captured in act 11), for example, along the common strand of the thread. Further, in particular embodiments, the first set of instructions for the thread printer (e.g., 272), for example, to print the multiple different colors, for instance, onto the common strand of thread, for example, before the stitching (e.g., in act 17) of the customized embroidery for the user includes instructions for printing at least one gradient of at least one color, for example, along the common strand of the thread. Even further, in certain embodiments, the planned pattern of stitches (e.g., 262, created in act 13, or both) includes overlay stitches, for example, that are visible in the (e.g., customized) embroidery, and underlay stitches, for instance, that are hidden from view (e.g., under overlay stitches). Further still, in particular embodiments, the underlay stitches are not included in the (e.g., at least one) gradient. As used herein, this means that the gradual transition of color in the gradient is entirely visible in the embroidery in the overlay stitches as opposed to part of the gradient being hidden from view in the underlay stitches. In some embodiments, for example, the underlay stitches have the same continuous color, for instance, as the point where the thread transitions from the overlay stitches to the underlay stitches.

Even further still, in some embodiments, the printing (e.g., in act 17, with printer 271, or both) of the (e.g., multiple different) colors (e.g., onto the common strand of thread) includes printing a repeat, for example, of a spot color sequence or a gradient transition, as examples of color pattern repeats that may be provided in different embodiments. Furthermore, in particular embodiments, the creating (e.g., in act 13) of the planned pattern of stitches (e.g., 262, for instance, created from the embroidery instructions) includes assigning (e.g., in act 13) the (e.g., multiple different) colors (e.g., captured in act 11) to stitch vectors, for example, in an embroidery design, for instance, used for the stitching (e.g., in act 17) of the (e.g., customized) embroidery (e.g., for the user). Moreover, in particular embodiments, the method (e.g., 10) includes outputting (e.g., in act 17) the stitch vectors (e.g., created in act 13), for example, to a (e.g., digital) thread printer (e.g., 271), for instance, used for the printing (e.g., in act 17) of the (e.g., multiple different) colors (e.g., onto the common strand of thread, for instance, immediately before the stitching) of the (e.g., customized) embroidery (e.g., for the user).

In various embodiments, the (e.g., multiple different) colors (e.g., of the color instructions, for instance, captured in act 11) include a start color (e.g., 2461 shown in FIG. 2 or 54 shown in FIG. 5), an end color (e.g., 2463 or 57), or both. Further, in some embodiments, the printing (e.g., in act 17, with printer 271, or both), for instance, of the (e.g., multiple different) colors (e.g., onto the common strand of thread) includes (e.g., gradually) fading, for example, from the start color (e.g., 2461 or 54), to the end color (e.g., 2463 or 57), or both. As used herein, "gradually fading" means that the color gradually changes over adjacent stitches. In some embodiments, the color gradually changes, for example, over 5, 10, 15, 20, 25, 30, 40, 50, 60, 70, 80, 90, 100, 125, 150, 200, 300, 400, 500, 750, or 1000 adjacent stitches, as examples. Moreover, where "gradually fading" is described herein, in other embodiments, fading may occur without the fading necessarily being gradual. As used herein, "fading", when referring to color, without the fading being described as "gradual fading", unless indicated otherwise, means that the color changes in at least two (2) different increments over at least three (3) different adjacent stitches. In other embodiments, the color changes or fades over 1, 2, 3, 5, 6, 7, 8, or 9 different stitches, as other examples. Still further, in some embodiments, the color instructions (e.g., captured in act 11) include a start location (e.g., 2471, for example, within the customized embroidery), an end location (e.g., 2473, for instance, within the customized embroidery), or both, Even further, in particular embodiments, the stitching (e.g., in act 17) of the (e.g., customized) embroidery (e.g., for the user), for instance, using the planned pattern of stitches (e.g., 262, created in act 13, or both) includes (e.g., gradually) fading, for example, from the start color (e.g., 2461 or 54), for example, at the start location (e.g., 2471), to the end color (e.g., 2463 or 57), for example, at the end location (e.g., 2473), or both. Even further still, in particular embodiments, the first set of instructions for the thread printer (e.g., 271), for example, to print the multiple different colors, for instance, onto the common strand of thread, for example, before the stitching (e.g., in act 17) of the customized embroidery, for instance, for the user, includes instructions for gradually fading from the start color (e.g., 2461) to the end color (e.g., 2463).

Further still, in some embodiments, for example, in the creating (e.g., in act 13) of the planned pattern of stitches (e.g., 262, for example, from the embroidery instructions, for instance, captured in act 11), determination (e.g., in act 13) of color of an intermediate stitch between the start location (e.g., 2471) and the end location (e.g., 2473) is based on a determined (e.g., determined in act 13) number of stitches between the start location (e.g., 2471) and the end location (e.g., 2473), a determined (e.g., in act 13) number of stitches between the start location (e.g., 2471) and the intermediate stitch, or both. Such an intermediate stitch may be located, for example, between the start location (e.g., 2471) and the end location (e.g., 2473), may have a color (e.g., partially faded) between the start color (e.g., 2461) and the end color (e.g., 2463), or both. Even further still, in particular embodiments, in the creating (e.g., in act 13) of the planned pattern of stitches (e.g., 262, for instance, from the embroidery instructions, for example, captured in act 11), determination (e.g., in act 13) of color of an intermediate stitch (e.g., between the start location (e.g., 2471) and the end location (e.g., 2473) is based on a determined (e.g., in act 13) length of stitch (e.g., stitch vectors) between the start location (e.g., 2471) and the end location (e.g., 2473), a determined length of stitch (e.g., stitch vectors) between the start location (e.g., 2471) and the intermediate stitch, or both.

Additionally, in certain embodiments, the (e.g., multiple different) colors (e.g., of the color instructions captured in act 11, of stitching parameters 24, or both) include a start color (e.g., 2461, 54, or both), an intermediate color (e.g., 2462, 55, 56, or a combination thereof), an end color (e.g., 2463, 57, or both), or a combination thereof. Further, in particular embodiments, the printing (e.g., in act 17, with printer 271, or both) of the (e.g., multiple different) colors (e.g., onto the common strand of thread) includes, for example, (e.g., gradually) fading from the start color (e.g., 2461, 54, or both) to the intermediate color (e.g., 2462, 55, 56, or a combination thereof), (e.g., gradually) fading from the intermediate color to the end color (e.g., 2463, 57, or both), or both. Even further, in various embodiments, the color instructions (e.g., captured in act 11, of stitching parameters 24, or both) include a start location (e.g., 2471) within the (e.g., customized) embroidery, an intermediate location (e.g., 2472) within the (e.g., customized) embroidery, an end location (e.g., 2473) within the (e.g., customized) embroidery, or a combination thereof. Still further, in certain embodiments, the stitching (e.g., in act 17) of the (e.g., customized) embroidery (e.g., for the user), for instance, using the planned pattern of stitches (e.g., 262, created in act 13, or both) includes (e.g., gradually) fading from (e.g., the start color, for instance, 2461, 54, or both) at the start location (e.g., 2471) to (e.g., the intermediate color, for instance, 2462, 55, 56, or a combination thereof) at the intermediate location (e.g., 2472), (e.g., gradually) fading from (e.g., the intermediate color) at the intermediate location to (e.g., the end color, for instance, (e.g., 2463, 57, or both) at the end location (e.g., 2473), or both. Even further still, in particular embodiments, the multiple different colors of the color instructions include an intermediate color and the first set of instructions for the thread printer (e.g., 271), for example, to print the multiple different colors, for instance, onto the common strand of thread, for example, before the stitching (e.g., in act 17) of the customized embroidery, for instance, for the user, includes instructions for gradually fading, for instance, from the start color (e.g., 2461 or 54) to the intermediate color (e.g., 2462, 55, or 56), from the intermediate color to the end color (e.g., 2463 or 57), or both. Moreover, in certain embodiments, the color instructions include an intermediate location within the customized embroidery and the first set of instructions and the second set of instructions include instructions for gradually fading from the start color (e.g., 2461 or 54) at the start location (e.g., 2471) to the intermediate color (e.g., 2462, 55, or 56) at the intermediate location (e.g., 2472), gradually fading from the intermediate color at the intermediate location to the end color (e.g., 2463 or 57) at the end location (e.g., 2473), or both.

Further still, in some embodiments, for example, in the creating (e.g., in act 13) of the planned pattern of stitches (e.g., 262, for example, from the embroidery instructions, for instance, captured in act 11), determination (e.g., in act 13) of color of an intermediate stitch between the start location (e.g., 2471) and an intermediate location (e.g., 2472) is based on a determined (e.g., determined in act 13) number of stitches between the start location (e.g., 2471) and the intermediate location (e.g., 2472), a determined (e.g., in act 13) number of stitches between the start location (e.g., 2471) and the intermediate stitch, or both. Such an intermediate stitch may be located, for example, between the start location (e.g., 2471) and the intermediate location (e.g., 2472), may have a color (e.g., partially faded) between the start color (e.g., 2461) and the intermediate color (e.g., 2462), or both. Even further still, in particular embodiments, in the creating (e.g., in act 13) of the planned pattern of stitches (e.g., 262, for instance, from the embroidery instructions, for example, captured in act 11), determination (e.g., in act 13) of color of an intermediate stitch (e.g., between the start location (e.g., 2471) and the intermediate location (e.g., 2472) is based on a determined (e.g., in act 13) length of stitch (e.g., stitch vectors) between the start location (e.g., 2471) and the intermediate location (e.g., 2472), a determined length of stitch (e.g., stitch vectors) between the start location (e.g., 2471) and the intermediate stitch, or both.

Moreover, in some embodiments, for example, in the creating (e.g., in act 13) of the planned pattern of stitches (e.g., 262, for example, from the embroidery instructions, for instance, captured in act 11), determination (e.g., in act 13) of color of an intermediate stitch between the intermediate location (e.g., 2472) and the end location (e.g., 2473) is based on a determined (e.g., determined in act 13) number of stitches between the intermediate location (e.g., 2472) and the end location (e.g., 2473), a determined (e.g., in act 13) number of stitches between the intermediate location (e.g., 2472) and the intermediate stitch, or both. Such an intermediate stitch may be located, for example, a stitch between the intermediate location (e.g., 2472) and the end location (e.g., 2473), may have a color (e.g., partially faded) between the intermediate color (e.g., 2462) and the end color (e.g., 2463), or both. Furthermore, in particular embodiments, in the creating (e.g., in act 13) of the planned pattern of stitches (e.g., 262, for instance, from the embroidery instructions, for example, captured in act 11), determination (e.g., in act 13) of color of an intermediate stitch (e.g., between the intermediate location (e.g., 2471) and the end location (e.g., 2473) is based on a determined (e.g., in act 13) length of stitch (e.g., stitch vectors) between the intermediate location (e.g., 2472) and the end location (e.g., 2473), a determined length of stitch (e.g., stitch vectors) between the intermediate location (e.g., 2472) and the intermediate stitch, or both. Similar determinations of color of intermediate stitches may be made where there are multiple intermediate colors or locations (e.g., 57 & 58).

In a number of embodiments, the planned pattern of stitches (e.g., 262, created in act 13, or both) includes an outline (e.g., 2621) design, for example, that includes vectors, for instance, having associated properties. In some embodiments, for example, the planned pattern of stitches (e.g., 262, created in act 13, or both) includes an outline (e.g., 2621) design that includes multiple segments (e.g., 2622). Further, in particular embodiments, the creating (e.g., in act 13) of the planned pattern of stitches (e.g., 262, for instance, from the embroidery instructions, for example, stitching parameters 24) includes using shape, properties, or both, for example, of each of the multiple segments (e.g., 2622). Stitching parameters 24 described herein are examples. Still further, in certain embodiments, the (e.g., multiple different) colors of the color instructions (e.g., of stitching parameters 24) include a start color (e.g., 2461, 54, or both), an end color (e.g., 2463, 57, or both), or both. Further still, in particular embodiments, the printing (e.g., in act 17, with printer 271, or both) of the (e.g., multiple different) colors (e.g., onto the common strand of thread) includes (e.g., gradually) fading, for example, from the start color (e.g., 2461, 54, or both) to the end color (e.g., 2463, 57, or both). Even further, in some embodiments, a particular segment of the multiple segments (e.g., 2622) includes both the start color (e.g., 2461, 54, or both) and the end color (e.g., 2463, 57, or both). Even further still, in certain embodiments, the (e.g., gradually) fading (e.g., from the start color to the end color) takes place within the particular segment of the outline (e.g., 2621) design. Moreover, in some embodiments, (e.g., wherein the multiple different colors of the color instructions include a start color and an end color), the printing of the multiple different colors (e.g., onto the common strand of thread) includes (e.g., gradually) fading from the start color (e.g., 2461, 54, or both) to the end color (e.g., 2463, 57, or both), a group of segments of the multiple segments (e.g., 2622) includes the start color and the end color, and the (e.g., gradually) fading from the start color to the end color takes place across a plurality of the segments within the group of segments of the outline (e.g., 2621) design. Further still, in a number of embodiments, the (e.g., gradually) fading (e.g., from the start color to the end color) partially takes place within each of the plurality of the segments (e.g., 2622) within the group of segments of the outline (e.g., 2621) design.

Another specific embodiment is a computerized method of creating embroidery (e.g., for a user) that includes (e.g., using a computing device, for instance, 25) capturing (e.g., in act 11) embroidery instructions (e.g., from the user), for example, in a browser window (e.g., 251). In a number of embodiments, the embroidery instructions include color instructions, for example, identifying multiple different colors, for instance, including a start color (e.g., 2461, 54, or both), an intermediate color (e.g., 2462, 55, 56, or a combination thereof), and an end color (e.g., 2463, 57, or both). Further, some embodiments include receiving (e.g., in act 12) the embroidery instructions (e.g., including the color instructions) at an embroidery engine (e.g., 261, for instance, on server 26), creating (e.g., in act 13) a planned pattern of stitches (e.g., 262, for instance, from the embroidery instructions), or both. Still further, some embodiments include stitching (e.g., in act 17) the embroidery (e.g., for the user), for example, using the planned pattern of stitches (e.g., 262, created in act 13, or both), for instance, including (e.g., gradually) fading color of the embroidery, for example, from the start color (e.g., 2461, 54, or both) to the intermediate color (e.g., 2462, 55, 56, or a combination thereof), from the intermediate color to the end color (e.g., 2463, 57, or both), or both.

Still another specific embodiment is a computerized method of creating (e.g., customized) embroidery (e.g., for a user), where the method includes (e.g., using a computing device, for instance, 25) capturing (e.g., in act 11) embroidery instructions, for instance, from the user (e.g., in a browser window, for instance, 251), for example, the embroidery instructions including color instructions, for instance, including a start location (e.g., 2471), an end location (e.g., 2473), or both. Some embodiments further include receiving (e.g., in act 12) the embroidery instructions (e.g., including the color instructions, for instance, captured in act 11) at an embroidery engine (e.g., 26, for example, on server 26), creating (e.g., in act 13) a planned pattern of stitches (e.g., 262, for instance, from the embroidery instructions captured in act 11), or both. Further, some embodiments include stitching (e.g., in act 17) the (e.g., customized) embroidery (e.g., for the user), for example, using the planned pattern of stitches (e.g., 262, created in act 13, or both), for instance, including (e.g., gradually) fading color of the (e.g., customized) embroidery, for example, from the start location (e.g., 2471), to the end location (e.g., 2473), or both.

In various embodiments, the color instructions (e.g., captured in act 11) include a start location (e.g., 2471), for instance, within the (e.g., customized) embroidery and an end location (e.g., 2473), for example, within the (e.g., customized) embroidery. Further, in a number of embodiments, the stitching (e.g., in act 17) of the (e.g., customized) embroidery, for instance, for the user, for example, using the planned pattern of stitches (e.g., 262, created in act 13, or both) includes (e.g., gradually) fading from the start location (e.g., 2471) to the end location (e.g., 2473). Still further, in various embodiments, in the creating (e.g., in act 13) of the planned pattern of stitches (e.g., 262), for example, from the embroidery instructions (e.g., captured in act 11), determination (e.g., in act 13) of color of an intermediate stitch between the start location and the end location is based on a determined (e.g., in act 13) length of thread between the start location and the end location, and a determined (e.g., in act 13) length of thread between the start location and the intermediate stitch. Even further, some embodiments include saving transitions, for example, and applying them to other embroidery outline designs, segments, or groups of segments, for instance. Further still, some embodiments include using transitions to create "themes" such as sport team colors or country flag colors, as examples, then applying the themes, for instance, to one or more designs, segments or groups of segments, as examples.

In particular embodiments, the first set of instructions for the thread printer (e.g., 271), for example, to print the multiple different colors, for instance, onto the common strand of thread, for example, before the stitching (e.g., in act 17) of the customized embroidery, for instance, for the user, includes instructions for gradually fading, for example, from the start color (e.g., 2461 or 54) to the end color (e.g., 2463 or 57). Further in some embodiments, a particular segment of the multiple segments includes both the start color and the end color and the gradually fading from the start color to the end color takes place within the particular segment of the outline design. Still further, in some embodiments, the first set of instructions for the thread printer (e.g., 271), for example, to print the multiple different colors, for instance, onto the common strand of thread, for example, before the stitching (e.g., in act 17) of the customized embroidery, for instance, for the user, includes instructions for gradually fading from the start color (e.g., 2461 or 54) to the end color (e.g., 2463 or 57) and a group of segments of the multiple segments includes the start color and the end color. In some embodiments, for example, the gradually fading from the start color to the end color takes place across a plurality of the segments within the group of segments of the outline design. Even further, in a number of embodiments, the gradually fading from the start color to the end color partially takes place within each of the plurality of the segments within the group of segments of the outline design.

In various embodiments, the user creates an embroidery design, for example, by drawing or importing artwork. Some embodiments, for example, include (e.g., the user) drawing shapes (e.g., then) assigning stitch types (e.g., run, satin or fill) and stitch parameters (e.g., color, density, underlay, pull and push compensation, and fill pattern). As well, in particular embodiments, the user can import an already-created embroidery design, for example, which already has shapes defined, stitch types, stitch parameters, or a combination thereof. Further, in certain embodiments, the user can then (e.g., optionally) edit the imported design (e.g., changing the shapes, stitch types, stitch parameters, or a combination thereof) or adding more shapes, as examples. In a number of embodiments, for example, for each segment of the design, the stitch engine generates stitches corresponding to the shape, stitch type, and stitch parameters, for example. Even further, in some embodiments, the stitch engine also generates stitches to connect each of the shapes. Even further, in various embodiments, the user defines one or more color transitions. Even further still, in particular embodiments, the user selects one or more segments (e.g., the entire design) and applies a color transition to the selected segments. Optionally, in some embodiments, color transitions can be applied to other segments or selections of segments.

In a number of embodiments, each segment of the design is rendered on the screen by drawing the stitches that correspond to the segment in the stitch color. Further, in some embodiments, for segments that have a color transition applied to them, the color of each stitch is determined using the following formula for start color s (e.g., 2461 or 54), end color e (e.g., 2463 or 57), total number of stitches between each color transition n, and current stitch i:

$$\text{current color}=(1-(i/(n-1)))*s+(i/(n-1))*e$$

Some embodiments further include using this formula, for example, to calculate color of intermediate stitches between a start color and an end color.

Still further, in a number of embodiments, once the user is satisfied with the design (e.g., providing approval in act 15), the system will need to output the design to two pieces of machinery: the printing device or thread printer (e.g., 271), which will color the thread, and the embroidery machine (e.g., 272), which will sew the stitches. In some embodiments, a thread printer (e.g., 271) prints an entire spool of thread before it is loaded on the embroidery machine (e.g., 272) and then stitched (i.e., "Type T"). In other embodiments, the thread printer (e.g., 271) is attached to the embroidery machine (e.g., 272) and prints the thread as it is fed into the sewing head of the embroidery machine (i.e., "Type C").

Certain embodiments include output calculations that include iterating through the stitches in the design and dividing them into sections based on the color. In particular embodiments, for example, a new section is started if any of the following four statements is true:

The color "type" is different from the previous stitch. (The "type" can be needle color, spot color, gradient, or pattern, as examples.)

Both stitches are needle colors, but the needle is different.

Both stitches are spot colors, but the ID of the spot color is different.

Both stitches are gradients, but the ID of the gradient is different.

In various embodiments, the stitches are divided into sections based on the color. In some embodiments, a new section is started each time there is a change in the color type of the stitch, compared with the previous stitch. Further, in a number of embodiments, two files are created. One file contains instructions for the thread printing device (e.g., 271). The "first set of instructions" described herein is an example. The other file has the stitch vectors in a format that is readable by the embroidery machine (e.g., 272). The "second set of instructions" described herein is an example.

In some embodiments, in the case of Type T, thread length for each section is added up. Thread length for a stitch is calculated, in some embodiments, as:

$$(\text{Stitch length})+(2*\text{fabric thickness})+(2/3*\text{stitch length})$$

In some embodiments, when the first set of instructions is output, these instructions tell the device the thread length for each section and the color. For a gradient, in a number of embodiments, these instructions include the start color (e.g., 2461 or 54) and the end color (e.g., 2463 or 57). In the case of Type C, in some embodiments, the first set of instructions includes the stitch number that each section begins and ends on, and the color for that section. The stitch numbers correspond to the stitch file, in some embodiments, that is also output (e.g., in the second set of instructions).

Other embodiments include an apparatus or method of obtaining or providing an apparatus or information, for instance, that include a novel combination of the features described herein. Even further embodiments include at least one means for accomplishing at least one functional aspect described herein. The subject matter described herein includes various means for accomplishing the various functions or acts described herein (e.g., of method 10) or that are apparent from the structure and acts described. Each function described herein is also contemplated as a means for accomplishing that function, or where appropriate, as a step for accomplishing that function. Moreover, various embodiments include certain (e.g., combinations of) aspects described herein. All combinations are potential embodiments. Some embodiments may include a subset of elements described herein and various embodiments include additional elements as well.

Further, various embodiments of the subject matter described herein include various combinations of the acts, structure, components, and features described herein, shown in the drawings, described in any documents that are incorporated by reference herein, or that are known in the art. Moreover, certain procedures can include acts such as manufacturing, obtaining, or providing components that perform functions described herein or in the documents that are incorporated by reference. Further, as used herein, the word "or", except where indicated otherwise, does not imply that the alternatives listed are mutually exclusive. Even further, where alternatives are listed herein, it should be understood that in some embodiments, fewer alternatives may be available, or in particular embodiments, just one alternative may be available, as examples.

What is claimed is:

1. A computerized method of creating customized embroidery for a user, the method comprising at least acts of:

using a computing device, capturing embroidery instructions from the user in a browser window, the embroidery instructions including: color instructions identifying multiple different colors including: a start color; an end color; a start location within the customized embroidery; and an end location within the customized embroidery;

receiving the embroidery instructions, including the color instructions, at an embroidery engine;

creating a planned pattern of stitches from the embroidery instructions wherein: the planned pattern of stitches comprises an outline design comprising multiple segments; the creating of the planned pattern of stitches from the embroidery instructions comprises using shape and properties of each of the multiple segments; and determination of color of an intermediate stitch between the start location and the end location is based on: a determined number of stitches between the start location and the end location; and a determined number of stitches between the start location and the intermediate stitch;

allowing the user to change the embroidery instructions while maintaining a particular color pattern;

outputting a first set of instructions for a thread printer to print the multiple different colors onto a common strand of thread before the stitching of the customized embroidery for the user, wherein: the first set of instructions comprises instructions for printing at least one gradient of at least one color along the common strand of the thread; and the planned pattern of stitches comprises: overlay stitches that are visible in the customized embroidery, and underlay stitches that are hidden from view under overlay stitches; and the underlay stitches are not included in the at least one gradient; and outputting a second set of instructions for an embroidery machine to stitch the customized embroidery with the common strand of thread.

2. The method of claim 1 further comprising stitching the customized embroidery for the user using the planned pattern of stitches including printing the multiple different colors onto the common strand of thread immediately before the stitching of the customized embroidery for the user.

3. The method of claim 1 wherein the embroidery engine is on a server.

4. The method of claim 1 wherein the first set of instructions for the thread printer to print the multiple different colors onto the common strand of thread before the stitching of the customized embroidery for the user comprises instructions for printing a repeat of: a spot color sequence or a gradient transition.

5. The method of claim 1 wherein the creating of the planned pattern of stitches from the embroidery instructions includes assigning the multiple different colors to stitch vectors in an embroidery design used for the stitching of the customized embroidery for the user.

6. The method of claim 1 wherein: the multiple different colors of the color instructions include, an intermediate color; and the first set of instructions for the thread printer to print the multiple different colors onto the common strand of thread before the stitching of the customized embroidery for the user comprises instructions for: gradually fading from the start color to the intermediate color, and gradually fading from the intermediate color to the end color.

7. The method of claim 6 wherein: the color instructions include an intermediate location within the customized embroidery; and the first set of instructions and the second set of instructions comprise instructions for: gradually fading from the start color at the start location to the intermediate color at the intermediate location, and gradually fading from the intermediate color at the intermediate location to the end color at the end location.

8. The method of claim 1 wherein: the first set of instructions for the thread printer to print the multiple different colors onto the common strand of thread before the stitching of the customized embroidery for the user comprises instructions for gradually fading from the start color to the end color; a particular segment of the multiple segments includes both the start color and the end color; and the gradually fading from the start color to the end color takes place within the particular segment of the outline design.

9. The method of claim 1 wherein: the first set of instructions for the thread printer to print the multiple different colors onto the common strand of thread before the stitching of the customized embroidery for the user comprises instructions for gradually fading from the start color to the end color; a group of segments of the multiple segments includes the start color and the end color; the gradually fading from the start color to the end color takes place across a plurality of the segments within the group of segments of the outline design, and the gradually fading from the start color to the end color partially takes place within each of the plurality of the segments within the group of segments of the outline design.

10. A computerized method of creating customized embroidery for a user, the method comprising at least acts of:

using a computing device, capturing embroidery instructions from the user in a browser window, the embroidery instructions including: color instructions identifying multiple different colors including: a start color; an end color; a start location within the customized embroidery; and an end location within the customized embroidery;

receiving the embroidery instructions, including the color instructions, at an embroidery engine;

creating a planned pattern of stitches from the embroidery instructions wherein: the planned pattern of stitches comprises an outline design comprising multiple segments; the creating of the planned pattern of stitches from the embroidery instructions comprises using shape and properties of each of the multiple segments; and determination of color of an intermediate stitch between the start location and the end location is based on: a determined length of stitch vectors between the start location and the end location; and a determined length of stitch vectors between the start location and the intermediate stitch;

allowing the user to change the embroidery instructions while maintaining a particular color pattern;

outputting a first set of instructions for a thread printer to print the multiple different colors onto a common strand of thread before the stitching of the customized embroidery for the user; and outputting a second set of instructions for an embroidery machine to stitch the customized embroidery with the common strand of thread.

11. The method of claim 10 further comprising stitching the customized embroidery for the user using the planned pattern of stitches including printing the multiple different colors onto the common strand of thread immediately before the stitching of the customized embroidery for the user; and wherein the embroidery engine is on a server.

12. The method of claim 10 wherein the first set of instructions for the thread printer to print the multiple different colors onto the common strand of thread before the stitching of the customized embroidery for the user comprises instructions for printing a repeat of: a spot color sequence or a gradient transition.

13. The method of claim 10 wherein the creating of the planned pattern of stitches from the embroidery instructions includes assigning the multiple different colors to stitch vectors in an embroidery design used for the stitching of the customized embroidery for the user.

14. The method of claim 10 wherein: the multiple different colors of the color instructions include an intermediate color; and the first set of instructions for the thread printer to print the multiple different colors onto the common strand of thread before the stitching of the customized embroidery for the user comprises instructions for: gradually fading from the start color to the intermediate color, and gradually fading from the intermediate color to the end color.

15. The method of claim 14 wherein: the color instructions include an intermediate location within the customized embroidery; and the first set of instructions and the second set of instructions comprise instructions for: gradually fading from the start color at the start location to the intermediate color at the intermediate location, and gradually fading from the intermediate color at the intermediate location to the end color at the end location.

16. The method of claim 10 wherein:

the first set of instructions comprises instructions for printing at least one gradient of at least one color along the common strand of the thread;

the planned pattern of stitches comprises: overlay stitches that are visible in the customized embroidery, and underlay stitches that are hidden from view under overlay stitches; and the underlay stitches are not included in the at least one gradient.

17. A computerized method of creating customized embroidery for a user, the method comprising at least acts of:

using a computing device, capturing embroidery instructions from the user in a browser window, the embroidery instructions including: color instructions identifying multiple different colors including: a start color; an end color; a start location within the customized embroidery; and an end location within the customized embroidery;

receiving the embroidery instructions, including the color instructions, at an embroidery engine;

creating a planned pattern of stitches from the embroidery instructions wherein: the planned pattern of stitches comprises an outline design comprising multiple segments; the creating of the planned pattern of stitches from the embroidery instructions comprises using shape and properties of each of the multiple segments; and determination of color of an intermediate stitch between the start location and the end location is based on: a determined number of stitches between the start location and the end location; and a determined number of stitches between the start location and the intermediate stitch;

allowing the user to change the embroidery instructions while maintaining a particular color pattern;

outputting a first set of instructions for a thread printer to print the multiple different colors onto a common strand of thread before the stitching of the customized embroidery for the user; and outputting a second set of instructions for an embroidery machine to stitch the customized embroidery with the common strand of thread.

18. The method of claim 17 wherein the first set of instructions for the thread printer to print the multiple different colors onto the common strand of thread before the stitching of the customized embroidery for the user comprises instructions for printing a repeat of: a spot color sequence or a gradient transition.

19. The method of claim 17 wherein the creating of the planned pattern of stitches from the embroidery instructions includes assigning the multiple different colors to stitch vectors in an embroidery design used for the stitching of the customized embroidery for the user.

20. The method of claim 17 wherein: the multiple different colors of the color instructions include an intermediate color; and the first set of instructions for the thread printer to print the multiple different colors onto the common strand of thread before the stitching of the customized embroidery for the user comprises instructions for: gradually fading from the start color to the intermediate color, and gradually fading from the intermediate color to the end color.

* * * * *